US008187898B2

(12) United States Patent
Yamamuro et al.

(10) Patent No.: US 8,187,898 B2
(45) Date of Patent: May 29, 2012

(54) METHOD FOR MANUFACTURING LIQUID DISCHARGE HEAD

(75) Inventors: Jun Yamamuro, Oita (JP); Masaki Ohsumi, Yokosuka (JP); Masahisa Watanabe, Yokohama (JP); Keiji Edamatsu, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 671 days.

(21) Appl. No.: 12/339,047

(22) Filed: Dec. 19, 2008

(65) Prior Publication Data

US 2010/0003773 A1 Jan. 7, 2010

(30) Foreign Application Priority Data

Dec. 21, 2007 (JP) ..... 2007-330951

(51) Int. Cl.
*B41J 2/16* (2006.01)

(52) U.S. Cl. ..... 438/21; 347/64; 216/27

(58) Field of Classification Search ..... 438/21, 438/694; 347/64; 216/27
See application file for complete search history.

(56) References Cited

U.S. PATENT DOCUMENTS

| | | | | |
|---|---|---|---|---|
| 4,335,389 | A * | 6/1982 | Shirato et al. | 347/64 |
| 4,370,668 | A * | 1/1983 | Hara et al. | 347/57 |
| 4,412,224 | A * | 10/1983 | Sugitani | 347/65 |
| 4,513,298 | A * | 4/1985 | Scheu | 347/64 |
| 4,609,427 | A * | 9/1986 | Inamoto et al. | 216/27 |
| 4,657,631 | A | 4/1987 | Noguchi | |
| 4,839,668 | A * | 6/1989 | Sato et al. | 347/65 |
| 4,839,669 | A * | 6/1989 | Sato et al. | 347/65 |
| 4,956,653 | A * | 9/1990 | Braun | 347/64 |
| 5,030,317 | A * | 7/1991 | Noguchi | 216/27 |
| 6,153,499 | A * | 11/2000 | Anda et al. | 438/579 |
| 6,622,373 | B1 * | 9/2003 | Tu | 29/611 |
| 7,103,972 | B2 * | 9/2006 | Chen et al. | 29/890.1 |
| 7,293,359 | B2 * | 11/2007 | Shaarawi et al. | 29/890.1 |
| 7,387,370 | B2 * | 6/2008 | Shaarawi et al. | 347/63 |
| 7,543,915 | B2 * | 6/2009 | Shaarawi et al. | 347/56 |
| 7,549,225 | B2 * | 6/2009 | Chen et al. | 29/890.1 |
| 7,798,612 | B2 * | 9/2010 | Shaarawi et al. | 347/63 |
| 2007/0141737 | A1 * | 6/2007 | Jacobs et al. | 438/21 |
| 2010/0003773 | A1 * | 1/2010 | Yamamuro et al. | 438/21 |

FOREIGN PATENT DOCUMENTS

JP 07-037799 2/1995

* cited by examiner

*Primary Examiner* — Mary Wilczewski
(74) *Attorney, Agent, or Firm* — Canon USA Inc IP Division

(57) ABSTRACT

A method for manufacturing a liquid discharge head provided with a substrate which has a layer made of silicon nitride and with a discharge port forming member which is disposed above the layer made of silicon nitride and has a discharge port for discharging liquid. The method includes providing a photosensitive layer that is to be the discharge port forming member above the layer made of silicon nitride, and forming the discharge port by exposing the photosensitive layer to i-line. The layer made of silicon nitride has a refractive index of 2.05 or more to light of a wavelength of 633 nm and irradiation with the i-line is performed in the exposure.

10 Claims, 4 Drawing Sheets

METHOD FOR MANUFACTURING LIQUID DISCHARGE HEAD

BACKGROUND OF THE INVENTION

1. Field of the Invention

The present invention relates to a method for manufacturing a liquid discharge head that discharges liquid and, in particular, a method for manufacturing an ink jet recording head that records an image by discharging ink to a recording medium.

2. Description of the Related Art

A liquid discharge head that discharges liquid is used, for example, as an ink jet recording head in an ink jet recording system.

An ink jet recording head typically includes a flow path, an energy generating element which is provided at a part of the flow path to generate energy for discharging ink, and a fine ink discharge port (referred to as an "orifice") for discharging ink.

As a method for manufacturing the ink jet recording head, U.S. Pat. No. 4,657,631 discusses the method that includes forming a pattern of flow paths with a photosensitive material on a substrate on which energy generating elements are formed, and coating the substrate with a covering resin to form a layer which is a path forming member to cover the pattern. The method further includes forming discharge ports on the covering resin layer and removing the photosensitive material used as the pattern. According to the manufacturing method, application of a photolithographic approach that is used in the semiconductor field enables highly precise and fine fabrication of the flow path and the discharge ports. In recent years, further improvements in recording speed and recording quality are required and therefore a number of discharge ports of an ink jet head increases and a dimension of each discharge port becomes very small, specifically a diameter of the discharge port is approximately several tens of μm to several μm.

To form discharge ports with higher precision, the inventors attempted to form the discharge ports with light of i-line single wavelength as an exposure light source in the method discussed in U.S. Pat. No. 4,657,631. Although the inventors intended to make circular discharge ports, the formed discharge ports had irregular shapes and some of them adversely affected discharge of liquid.

The inventors investigated the result of the experiment and found following possible causes for the irregular shapes described above. More specifically, the light used for exposure reaches the substrate, reflects on the substrate surface, and after that reaches the resin for forming a discharge port, so that the shapes of the discharge ports are made different from a desired one.

SUMMARY OF THE INVENTION

The present invention is directed to a method for manufacturing an ink jet recording head capable of forming a discharge port of a desired shape with high precision by the photolithographic approach using i-line exposure.

According to an aspect of the present invention, a method for manufacturing a liquid discharge head provided with a substrate having a layer made of silicon nitride and with a discharge port forming member disposed above the layer made of silicon nitride and having a discharge port for discharging liquid, the method includes providing a photosensitive layer that is to be the discharge port forming member above the layer made of silicon nitride, and forming the discharge port by exposing the photosensitive layer to i-line, wherein the layer made of silicon nitride has a refractive index of 2.05 or more to light of a wavelength of 633 nm and irradiation with the i-line is performed in the exposure.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

In the description, an ink jet recording system is explained as one example to which the present invention can be applied, but an applicable area of the present invention is not limited thereto and the present invention can also be applied to biochip production and printing of electronic circuits.

A liquid discharge head can be mounted on an apparatus such as a printer, a copying machine, a facsimile machine having a communication system, a word processor having a printer unit, and also an industrial recording apparatus combined with various processing devices. For example, the liquid discharge head can be used for biochip production, printing of electronic circuits, and spraying of chemicals.

As one application, the liquid discharge head according to the present exemplary embodiment can be used for recording on various recording mediums such as paper, thread, fiber, cloth, leather, metal, plastic, glass, wood and ceramic. In the context of the present specification, "recording" means to provide not only a meaningful image such as a character and graphics but also a meaningless image such as a pattern to a recording medium.

First, an ink jet recording head (hereinafter referred to as a "recording head") is described as one application example of the liquid discharge head.

Figure 1:
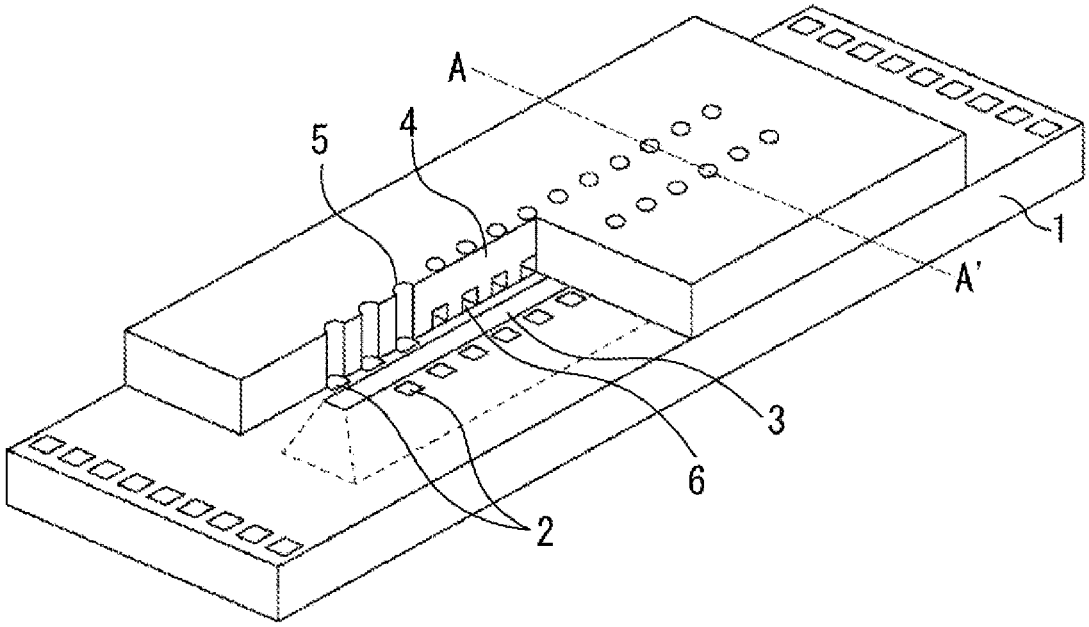
FIG. 1 is a perspective view illustrating an example of an ink jet recording head according to an exemplary embodiment of the present invention.

FIG. 1 is a perspective view illustrating the recording head according to an exemplary embodiment of the present invention.

The recording head according to the exemplary embodiment of the present invention includes a substrate 1 on which energy generating elements 2 for generating energy used to discharge ink are formed with a predetermined pitch. In the substrate 1, an ink supply port 3 for supplying ink opens between two rows of the energy generating elements 2. On the substrate 1, discharge ports 5 opening above the respective energy generating elements 2, and individual ink flow paths 6 communicating with the respective discharge ports 5 from the ink supply port 3 are formed.

A discharge port forming member 4 functions as a flow path forming member for forming each of the individual flow paths 6. The discharge port forming member 4 communicates from the ink supply port 3 to the respective discharge ports 5. The flow path forming member may be formed separately from the discharge port forming member 4. The positions of the discharge ports 5 are not limited to positions where the discharge ports face the energy generating elements 2.

The recording head is disposed in such a manner that a surface on which the discharge ports 5 are formed faces a recording surface of a recording medium. In the recording head, the energy generated by the energy generating elements 2 is applied to the ink filled in the flow path via the ink supply port 3. As a result, ink droplets are discharged from the discharge ports 5, and attached to the recording medium to perform recording. As the energy generating element 2, an electrothermal conversion element (a heater) which generates thermal energy and a piezoelectric element which generates mechanical energy can be used. However, the energy generating element 2 is not limited to the electrothermal conversion element or the piezoelectric element. Referring to FIG. 2, a structure of the recording head according to the exemplary embodiment of the present invention will be described in detail below.

Figure 2A:
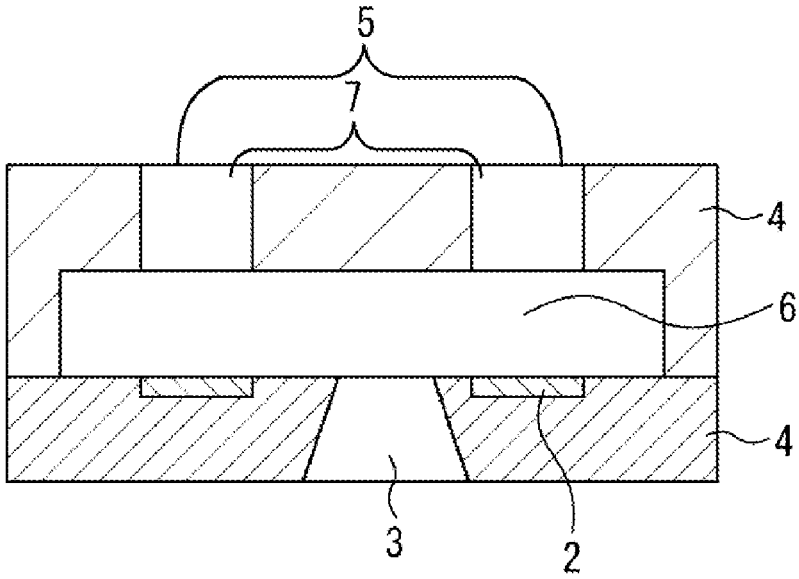
FIGS. 2A and 2B are schematic cross sectional views illustrating an example of an ink jet recording head according to the exemplary embodiment of the present invention, respectively.
Figure 2B:
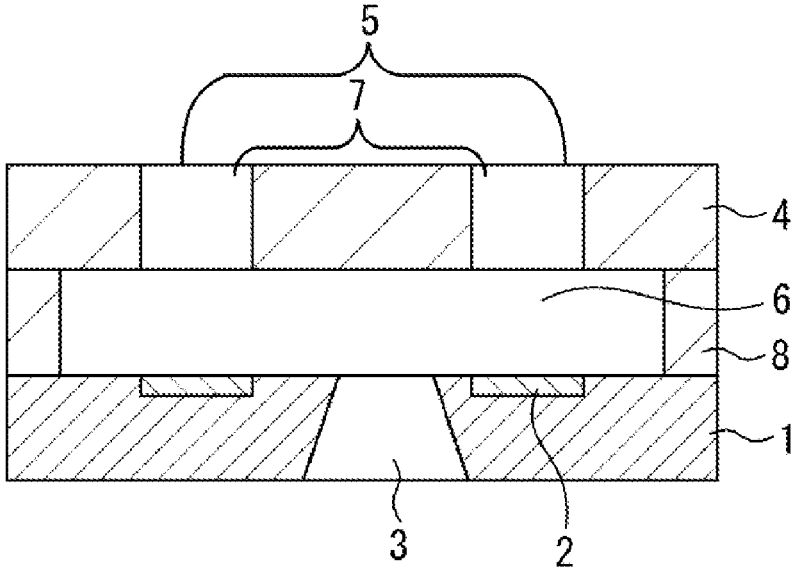

FIGS. 2A and 2B are schematic cross sectional views illustrating the recording head according to the exemplary embodiment of the present invention taken along the line A-A' of FIG. 1.

As illustrated in FIG. 2A, the discharge port 5 is defined as an opening portion on a surface of the discharge port forming member 4, and a portion communicating between the flow path 6 and the discharge port 5 is distinctly referred to as a discharge portion 7. The discharge portion 7 may have a tapered shape such that an area of a cross section parallel to the substrate 1 gradually decreases toward the discharge port 5 from the substrate 1 side.

As illustrated in FIG. 2B, a flow path forming member 8 that serves as a wall of the flow path 6 may be provided between the discharge port forming member 4 and the substrate 1.

Next, the substrate 1 used for the ink jet recording head according to the present exemplary embodiment will be described in detail below.

Figure 3A:
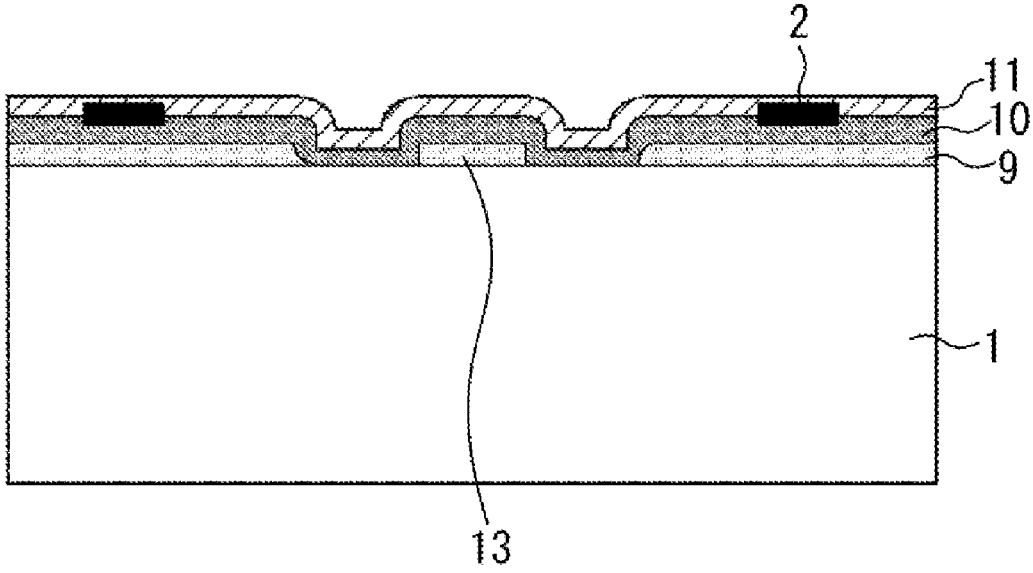
FIGS. 3A and 3B are schematic cross sectional views illustrating an example of a substrate of an ink jet recording head according to the exemplary embodiment of the present invention.
Figure 3B:
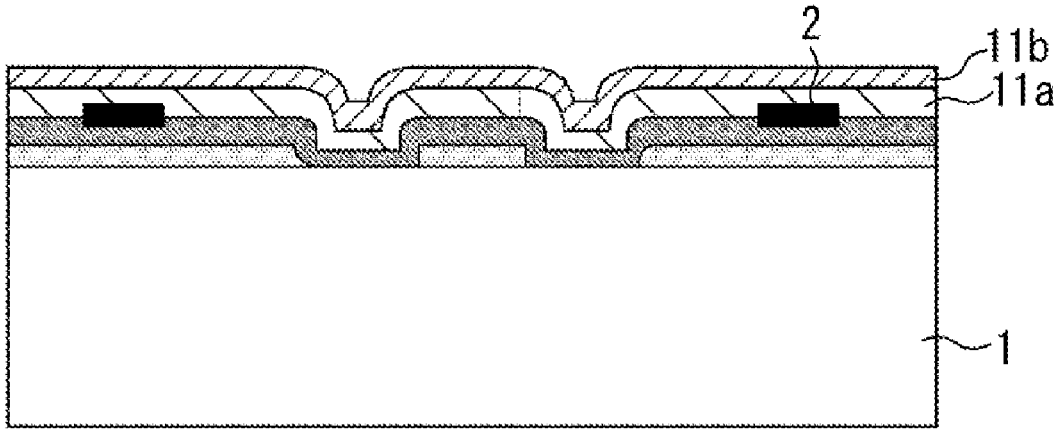

FIGS. 3A and 3B are cross sectional views, similar to FIGS. 2A and 2B, and illustrate the substrate 1 before formation of the ink supply port 3.

As illustrated in FIG. 3A, a thermally-oxidized film 10 and a silicon oxidized film 9 which is an insulating layer formed on the thermally-oxidized film 10 are provided on the substrate 1, and the energy generating element 2 is provided on the silicon oxidized film 9. Moreover, on the energy generating element 2, an electrode (not illustrated) for driving the energy generating element 2 is provided. Further, a silicon nitride layer 11 is provided on a substrate surface to protect the above described films and element. The silicon nitride layer 11 has a refractive index of 2.05 or more to light of a wavelength of 633 nm to suppress reflection on the substrate surface during exposure with i-line described below. A thickness of the silicon nitride layer 11 can be 250 nm or more. To improve precision in forming the ink supply port 3, a sacrificial layer 13 may be provided.

As another exemplary embodiment, two layers consisting of a first silicon nitride layer 11*a* (nearer to the substrate 1) and a second silicon nitride layer 11*b* (farther from the substrate 1) may be provided on the substrate surface, as illustrated in FIG. 3B. For example, after the first silicon nitride layer 11*a* having a refractive index of 2.05 or more to the light of the wavelength of 633 nm is formed, the second silicon nitride layer 11*b* configured to have a refractive index less than 2.05 at the wavelength of 633 nm may be provided on the first silicon nitride layer 11*a*. On the contrary, the first silicon nitride layer 11*a* may be configured to have a refractive index less than 2.05 at the wavelength of 633 nm and the second silicon nitride layer 11*b* which is formed on the first silicon nitride layer 11*a* may be configured to have a refractive index of 2.05 or more at the wavelength of 633 nm.

The silicon nitride layer having the refractive index of 2.05 or more at the wavelength of 633 nm may be provided on an outermost surface layer of the substrate. In addition, another layer may be provided on the silicon nitride layer having the refractive index of 2.05 or more at the wavelength of 633 nm. Further, a plurality of the silicon nitride layers having the refractive index of 2.05 or more at the wavelength of 633 nm may be provided on the substrate 1.

It has been known that there is a linear relationship between the refractive index of silicon nitride at the wavelength of 633 nm and a composition ratio of silicon to nitrogen.

Next, one example of a method for manufacturing the recording head according to the present invention will be described in detail below.

FIGS. 4A to 4G are schematic cross sectional views illustrating an example of the method for manufacturing the recording head according to the present invention with successive process, and a position of the cross section is the same as in FIGS. 2A and 2B.

Figure 4A:
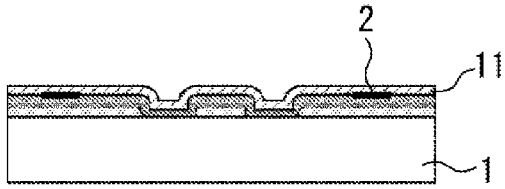
FIGS. 4A to 4G are schematic cross sectional views illustrating an example of a method for manufacturing an ink jet recording head according to the exemplary embodiment of the present invention.

As illustrated in FIG. 4A, the substrate 1 is prepared with the silicon nitride layer 11 on its surface. To suppress the reflection on the substrate surface during exposure with the i-line, the silicon nitride layer 11 is configured to have the refractive index of 2.05 or more at the wavelength of 633 nm. The silicon nitride layer 11 can have a thickness of 250 nm or more. A shape and a material of the substrate 1 is not particularly limited as long as the substrate 1 can function as a member constituting the flow path 6 and as a member supporting the discharge port forming member 4 that forms the flow path 6 and the discharge port 5 described below. In the present exemplary embodiment, a silicon substrate is used in order to form the ink supply port 3 penetrating through the substrate 1 by anisotropic etching described below. The energy generating element 2 provided on the substrate 1 is covered with the silicon nitride layer 11.

Figure 4B:
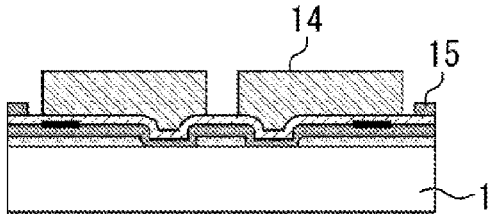

As illustrated in FIG. 4B, a pattern 14 as a mold for an ink flow path is formed on the silicon nitride layer 11. As a material of the pattern 14, a positive photosensitive resin such as polymethyl isopropenyl ketone and polymethyl methacrylate can be used. A film thickness of the pattern 14 can be desirably set to 10 to 20 μm, but the present invention is not limited to these values.

An adhesive layer 15 made of polyether amide or the like may be formed to improve adhesiveness between the flow path forming member which is formed in a later process and the substrate 1.

Figure 4C:
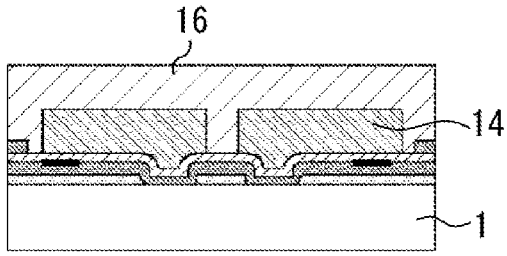

As illustrated in FIG. 4C, on the substrate 1 having the flow path pattern 14 formed thereon, a negative photosensitive resin layer 16 which is to be a discharge port forming member is formed by a spin-coating method, roll-coating method, slit-coating method or the like. At this time, it is desirable to form the negative photosensitive resin layer 16 so that a distance between the discharge port 5 and the substrate 1 is approximately 20 to 30 μm at the end of the process, but the present invention is not limited to these values.

The negative photosensitive resin layer 16 is suitably formed by a negative photosensitive resin. The negative photosensitive resin layer 16 ultimately functions as the discharge port forming member which forms, for example, a part of flow path such as a ceiling. Accordingly, the negative photosensitive resin layer 16 is required to have high mechanical strength as a structural material, adhesiveness to the substrate, resistance to ink, and a resolution for drawing fine patterns for the ink discharge port. As a material satisfying these properties, a cationic polymerizable epoxy resin composition can be suitably used.

As an epoxy resin, a novolac epoxy resin, an epoxy resin having a bisphenol A skeleton, and a polyfunctional epoxy resin having an oxycyclohexane skeleton can be suitably used, but epoxy resin is not limited thereto. These types of epoxy resin are desirably solid at a normal temperature.

As a photo cationic polymerization initiator for curing the above mentioned epoxy resins, a compound which generates an acid by light irradiation may be used. As such a compound, an aromatic sulfonium salt and an aromatic iodonium salt can be used, for example, but the compound is not limited thereto. As an example of the aromatic sulfonium salt, SP-170 and 172 (ADEKA Corporation) are commercially available.

Further, an additive agent may be added to the composition as needed. For example, a flexibility imparting agent may be added to lower elastic modulus of the epoxy resin or a silane coupling agent may be added to further improve the adhesive poser respective to the substrate.

Figure 4D:
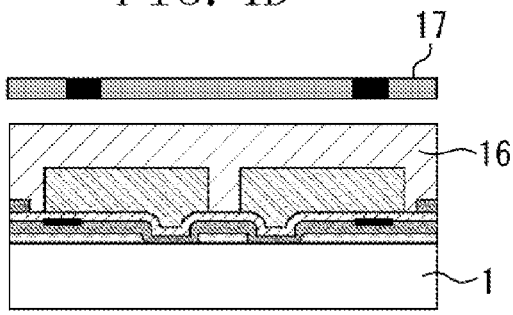

Next, as illustrated in FIG. 4D, the negative photosensitive resin layer 16 is exposed using a mask 17 so as to form the discharge port 5. At this time, the i-line is used for exposure. The i-line is light having a central wavelength of 365 nm and can be substantially regarded as a single line. The silicon nitride layer 11 is irradiated with i-line which has passed through the negative photosensitive resin layer 16. However, as described above, i-line reflection is suppressed by the silicon nitride layer 11 having the refractive index of 2.05 or more at the wavelength of 633 nm. Hence, the quantity of light reaching the negative photosensitive resin layer 16 by the reflection from the substrate 1 side can be decreased.

Figure 4E:
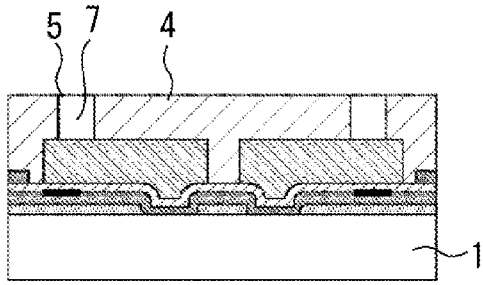

Next, the discharge portion 7 is formed along with the discharge port 5 as illustrated in FIG. 4E by a developing process. As described above, the negative photosensitive resin layer 16 is patterned to form the discharge port forming member 4. From a viewpoint of discharging minute droplets, it is desirable to set a diameter of the discharge port 5 to approximately 5 to 15 μm.

Figure 4F:
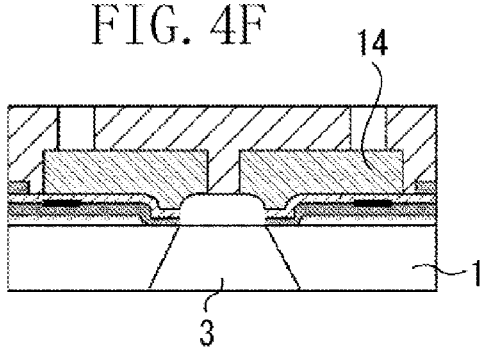

Next, the ink supply port 3 that penetrates the substrate 1 is formed, as illustrated in FIG. 4F. Anisotropic etching may be used as a method for forming the ink supply port 3 using a resin composition having resistance against etching liquid as an etching mask.

Figure 4G:
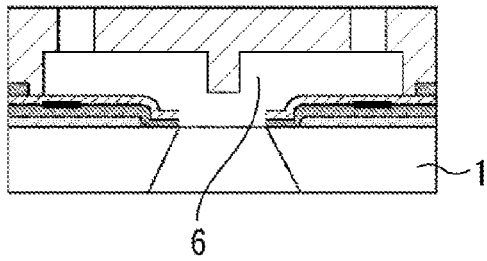

Next, the ink flow path 6 is formed by removing the pattern 14, as illustrated in FIG. 4G. Further, heating treatment is performed, members for supplying ink are joined (not illustrated), and electric joining (not illustrated) for driving the energy generating element 2 are implemented as needed to complete manufacturing of the recording head.

Next, an example of the recording head according to the present exemplary embodiment will be described more specifically.

As a first example, the substrate 1 that includes a heater 2 made of TaSiN as an energy generating element and the silicon nitride layer 11 which was provided on the surface of the substrate 1 to cover the heater 2 was prepared (FIG. 4A). The refractive index of the silicon nitride layer 11 is 2.1 at a wavelength of 633 nm. The composition ratio of silicon to nitrogen is 1. The silicon nitride layer 11 was formed by a plasma chemical vapor deposition (CVD) method under the following conditions.

$SiH_4$ gas flow rate 160 sccm
$NH_3$ gas flow rate 40 sccm
$N_2$ gas flow rate 1500 sccm
Gas pressure 700 Pa
Temperature of the substrate 350° C.
Radio frequency (RF) power 500 W Next, a positive photosensitive resin (ODUR made by TOKYO OHKA KOGYO CO., LTD.) was formed on the surface of the substrate 1 by spin-coating and was patterned to form the pattern 14 of a flow path (FIG. 4B).

Next, the following composition was dissolved in xylene and spin-coated on the pattern 14, then baked to form the negative photosensitive resin layer 16 (FIG. 4C).

| Name | Manufacturer | Weight Portion (wt %) |
|---|---|---|
| EHPE-3150 | DAICEL CHEMICAL INDUSTRIES, LTD. | 94 |
| A-187 | Nippon Unicar Company Limited | 45 |
| SP-170 | ADEKA CORPORATION | 0.15 |

Next, the negative photosensitive resin layer 16 was exposed to the light of the wavelength of 365 nm using an i-line stepper, at an exposure amount of 5000 J/m$^2$ (FIG. 4D). At this time, a mask having a discharge port pattern in circular shape was used.

Next, the exposed negative photosensitive resin layer 16 was developed by xylene to form the discharge port 5 having a diameter of 10 μm (FIG. 4E).

Next, the substrate 1 was treated by the anisotropic etching using tetramethylammonium hydroxide (TMAH) solution from the rear face thereof to form the ink supply port 3 (FIG. 4F).

Then, the pattern 14 was removed using methyl lactate solution to form the flow path 6 (FIG. 4G).

Finally, required electrical connection was performed to complete the manufacturing of the recording head (not illustrated).

A recording head according to a second example was prepared similar to the first example, except that a refractive index of a silicon nitride layer was 2.05 at a wavelength of 633 nm and the composition ratio of silicon to nitrogen is 0.95. The silicon nitride layer was formed by the method described in the first example and controlling the $SiH_4$ gas flow rate and the $NH_3$ gas flow rate.

Printing evaluation was performed with respect to the manufactured recording heads of each example by mounting the recording heads on a recording apparatus. Each recording head shows a satisfactory result.

With regard to a recording head of a third example, a difference from the first example is that two silicon nitride layers (an upper layer 11*b* and a lower layer 11*a* (refer to FIG. 3B)) were prepared as the silicon nitride layer 11. The upper layer 11*b* has a refractive index of 2.0 at a wavelength of 633 nm and the lower layer 11*a* has a refractive index of 2.4 at a wavelength of 633 nm. The composition ratio of silicon to nitrogen is 1.45. The silicon nitride layer was formed by the method described in the first example and controlling the $SiH_4$ gas flow rate and the $NH_3$ gas flow rate. Other than that, the recording head was prepared similar to the first example.

Printing evaluation for the recording head of the third example showed a satisfactory result.

With regard to a recording head of a fourth example, a difference from the first example is that two silicon nitride layers (an upper layer 11*b* and a lower layer 11*a* (refer to FIG. 3B)) were prepared as the silicon nitride layer 11. The upper layer 11*b* has a refractive index of 2.1 at a wavelength of 633 nm and the lower layer 11*a* has a refractive index of 2.4 at a wavelength of 633 nm. The silicon nitride layer is formed by the method described in the first example and controlling the $SiH_4$ gas flow rate and the $NH_3$ gas flow rate. Other than that, the recording head was prepared similar to the first example.

With regard to a recording head of a fifth example, a difference from the first example is that two silicon nitride layers (an upper layer 11*b* and a lower layer 11*a* (refer to FIG. 3B)) were prepared as the silicon nitride layer 11. The upper layer 11*b* has a refractive index of 2.4 at a wavelength of 633 nm and the lower layer 11*a* has a refractive index of 2.0 at a wavelength of 633 nm. The silicon nitride layer is formed by the method described in the first example and controlling the $SiH_4$ gas flow rate and the $NH_3$ gas flow rate. Other than that, the recording head was prepared similar to the first example.

With regard to a recording head of a sixth example, a difference from the first example is that two silicon nitride layers (an upper layer 11*b* and a lower layer 11*a* (refer to FIG. 3B)) were prepared as the silicon nitride layer 11. The upper layer 11*b* has a refractive index of 1.9 at a wavelength of 633 nm and the lower layer 11*a* has a refractive index of 2.6 at a wavelength of 633 nm. The silicon nitride layer is formed by the method described in the first example and controlling the $SiH_4$ gas flow rate and the $NH_3$ gas flow rate. Other than that, the recording head was prepared similar to the first example.

With regard to a recording head of a comparative example, a difference from the first example is that the silicon nitride layer 11 which is formed on the surface of the substrate 1 has a refractive index of 2.0 to light of a wavelength of 633 nm. Other than that, the recording head was prepared similar to the first example.

Printing results of the recording head of the comparative example often showed streaky unevenness which seems to arise from twisting. In the discharge ports in the recording head of the comparative example, a distorted circular discharge port was found by observation.

As an evaluation of the recording heads of the exemplary embodiment and the comparative example, a x/y ratio of the discharge port (x is a diameter and y is a radius orthogonal to the diameter x) was measured. While the x/y ratio of the discharge port of the comparative example was about 117%, that of the exemplary embodiment was about 100%. In other words, the discharge port with a nearly perfect circle can be provided by the exemplary embodiment.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-330951 filed Dec. 21, 2007, which is hereby incorporated by reference herein in its entirety.

What is claimed is:

1. A method for manufacturing a liquid discharge head provided with a substrate having a layer made of silicon nitride and with a discharge port forming member disposed above the layer made of silicon nitride and having a discharge port for discharging liquid, the method comprising:

providing a photosensitive layer that is to be the discharge port forming member above the layer made of silicon nitride; and forming the discharge port by exposing the photosensitive layer to i-line, wherein the layer made of silicon nitride has a refractive index of 2.05 or more to light of a wavelength of 633 nm and irradiation with the i-line is performed in the exposure.

2. The method according to claim 1, wherein the photosensitive layer is a negative photosensitive resin layer.

3. The method according to claim 1, wherein the substrate is provided with an energy generating element for generating energy used to discharge liquid and the layer made of silicon nitride covers the energy generating element.

4. The method according to claim 3, wherein the discharge port is provided at a position where the discharge port faces the energy generating element.

5. The method according to claim 1, wherein the providing step includes:

providing a pattern having a shape of a flow path communicating with the discharge port on a surface of the substrate; and forming the photosensitive layer above the substrate to cover the pattern.

6. The method according to claim 1, further comprising providing an additional layer made of silicon nitride on the layer made of silicon nitride.

7. The method according to claim 1, wherein the layer made of silicon nitride is provided on an additional layer made of silicon nitride.

8. The method according to claim 1, further comprising providing an additional layer made of silicon nitride having a refractive index of less than 2.05 to the light of the wavelength of 633 nm on the layer made of silicon nitride.

9. The method according to claim 1, wherein the layer made of silicon nitride is provided on an additional layer made of silicon nitride having a refractive index of less than 2.05 to the light of the wavelength of 633 nm.

10. The method according to claim 8, wherein the additional layer made of silicon nitride is provided on an outermost surface layer of the substrate.

* * * * *